United States Patent [19]

Carlsson

[11] Patent Number: 4,801,078

[45] Date of Patent: Jan. 31, 1989

[54] ARRANGEMENT ON PACKING CONTAINERS

[75] Inventor: Lars Carlsson, Blentarp, Sweden

[73] Assignee: AB Tetra Pak, Lund, Sweden

[21] Appl. No.: 89,154

[22] Filed: Aug. 25, 1987

[30] Foreign Application Priority Data

Sep. 16, 1986 [SE] Sweden ..... 8603888

[51] Int. Cl.[4] ..... B65D 5/70

[52] U.S. Cl. ..... 229/123.2; 229/125.37; 229/160.2

[58] Field of Search ..... 229/123.2, 125.05, 125.19, 229/125.32, 125.37, 125.42, 160.2, 137, 48 T, 485 A, 3.1; 383/61, 78, 83

[56] References Cited

U.S. PATENT DOCUMENTS

| | | | |
|---|---|---|---|
| 2,196,243 | 4/1940 | Bensel | 229/3.1 |
| 2,382,573 | 8/1945 | Moore | 229/48 T |
| 2,765,974 | 10/1956 | Phipps et al. | 383/78 |
| 2,959,336 | 11/1960 | Mosse et al. | 229/3.1 |
| 3,069,066 | 12/1962 | Peckham | 383/78 |
| 3,272,425 | 9/1966 | Bendersky et al. | 229/123.2 |
| 3,473,725 | 10/1969 | Wiehahn | 383/78 |
| 3,869,078 | 3/1975 | Braun | 206/607 |
| 3,942,708 | 3/1976 | Christensson | 229/48 T |
| 4,362,245 | 12/1982 | Kuchenbecker | 206/628 |

FOREIGN PATENT DOCUMENTS

| | | | |
|---|---|---|---|
| 2934992 | 6/1986 | Fed. Rep. of Germany . | |
| 117684 | 9/1969 | Norway . | |
| 937011 | 9/1963 | United Kingdom | 229/48 T |

*Primary Examiner*—Stephen Marcus
*Assistant Examiner*—Gary E. Elkins
*Attorney, Agent, or Firm*—Burns, Doane, Swecker & Mathis

[57] ABSTRACT

An arrangement on packing containers of flexible packing material, this arrangement making possible a tight closing and simple opening of the top part of the packing container. In, for example, a gable-top package (1) the arrangement comprises a sealing film (8) projecting outside the top edge of the packing container material, which after conventional shaping of the top part of the packing container is sealed in a sealing zone (9) and is provided with a projecting tearing strip (11). The film (8) is a laminate sealable to the packing material with a suitable barrier layer, e.g. Al-foil, and, owing to its small thickness, can be simply sealed in a gas-tight manner to itself as well as to the inside of the packing material.

5 Claims, 2 Drawing Sheets

ARRANGEMENT ON PACKING CONTAINERS

FIELD OF THE INVENTION

The present invention relates generally to packing containers and, more particularly, to packing containers of the type manufactured by folding and sealing of a flexible packing material, which along the top edge of the packing container has panels which jointly form a sealing fin of multiple material thickness.

BACKGROUND OF THE INVENTION

Non-returnable packages for beverages and other contents are manufactured at present in general from a laminated material comprising a carrier layer of fibrous material, e.g. paper, which is surrounded on either side by thin, thermoplastic layers. The thermoplastic layers render the packing container liquid-tight and make possible, moreover, the heat-sealing of longitudinal joints, top and bottom. Many different types of packing containers of this type are known. Such packing containers are manufactured also in aseptic form for being filled with previously sterilized contents, e.g. heat-sterilized milk. The packing container here has to be provided with a gas-tight barrier layer, and in general the packing laminate to this end comprises a thin layer of aluminium foil or some plastic material of high gas-tightness. In this manner the packing material can be made completely gas-tight and bacteria-tight. It is not sufficient, however, to make the actual material bacteria-tight but, naturally, the joints and seals which are required for converting the material to a finished packing container must also be completely gas-tight. This is a major problem in certain types of known packing containers. This is true in particular for openable top parts on so-called gable-top packages, since these packages generally are opened by breaking the top seal itself, and there is thus the choice between providing a strong seal which is gas-tight but difficult to open, or a weaker seal which is easy to open but may entail a risk of leakage. The reason that these problems are particularly marked in packing containers of the gable-top type is that the top here comprises two bellows-folds folded against each other, which are located between two outer sealing panels and which are sealed together with these. Between the points of the bellows-folds directed against each other a channel is formed, owing to the thickness of the material which is difficult to make completely bacteria-tight. Since the packing container is opened by breaking the seal between different parts of the sealing fin and the bellows-fold, it is necessary, moreover, purposely to limit the strength of the seal if the opening function of the package is to be retained. Attempts to produce an aseptic packing container of the gable-top type have been unsuccessful up to now, largely because of these difficulties.

OBJECT AND SUMMARY OF THE INVENTION

It is an object of the present invention to provide a packing container in which the closing as well as the opening arrangement are of such a design that the abovementioned problems are eliminated and demands for tightness and openability are fulfilled.

It is a further object to provide an arrangement on a packing container of the gable-top type by means of which the leakages which are caused by different numbers of material layers having to be top-sealed in the sealing fin are wholly eliminated.

It is a further object of the present invention to provide an arrangement which makes it possible on packing containers of the gable-top type to provide a top seal which is satisfactory from an aseptic point of view as well as a top seal of good and flexible openability.

These and other objects have been achieved in accordance with the invention in that an arrangement of the type described in the introduction has been given the characteristic that a sealing film joined to the inside of the packing material has a sealing zone located outside the top edge of the packing container, wherein several layers of the sealing film are sealed to one another.

Preferred embodiments of the arrangement in accordance with the invention have been given, moreover, the characteristics which are evident from the subsidiary claims.

By making use in acordance with the invention of a sealing film joined to the inside of the packing material in order to provide the actual top seal as well as a part which can be torn off on opening the packing container, a top seal at the part of the sealing fin of the packing container which comprises different numbers of fibrous layers is avoided, thus making the package top completely tight and also easy to open. The sealing of the different layers of the sealing film folded many times presents no difficulties, since the thickness of the sealing film in this context is negligible. Through joining the free projecting part of the sealing film to a tearing strip, a readily openable package is obtained.

BRIEF DESCRIPTION OF THE DRAWING

A preferred embodiment of the arrangement in accordance with the invention will now be described in detail with special reference to the enclosed drawing which only show the details indispensable for an understanding of the invention.

DETAILED DESCRIPTION OF A PREFERRED EMBODIMENT

It is the object of the arrangement in accordance with the invention to make possible a seal of a packing container which is gas-tight and bacteria-tight, at the same time as the arrangement furnishes the opportunity of opening the packing container in a simple manner. The arrangement can be used on a number of different types of packing containers, but first and foremost on such packing containers which are intended for sterile contents, since in this connection extremely high demands are made on the gas-tightness and bacteria-tightness. It is particularly advantageous to utilize the arrangement in accordance with the invention on such types of packing containers where the top seal is realized in the form of a sealing fin which comprises bellows-folds folded inwards. This type of top seal occurs first and foremost on packing containers of the so-called gable-top type, and the preferred embodiment of the arrangement in accordance with the invention which will be described in the following is shown, therefore, as it is realized on this type of packing container. However the arrangement may also be used on other types of packing containers, with or without modifications, within the framework of the claims following hereinafter.

The packing container shown in the Figures is substantially of the conventional gable-top type. The packing container is manufactured from a laminated material which comprises a carrier layer of fibrous material, e.g. paper, which is coated on either side with thin layers of thermoplastic material, preferably polyethylene. On the surface of the packing material facing towards the inside of the packing container there is also a layer of aluminium foil which in turn is covered by a further, thin layer of polyethylene. This type of packing material is well-known and is used advantageously for the manufacture of packing containers which are to be used for the kind of contents which make high demands on the gas and bacteria tightness of the material.

Figure 2:
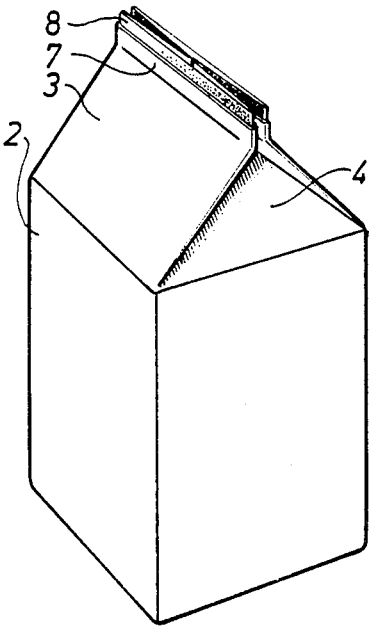
FIG. 2 is a perspective view of the packing container in accordance with FIG. 1 in a partially closed position.
Figure 3:
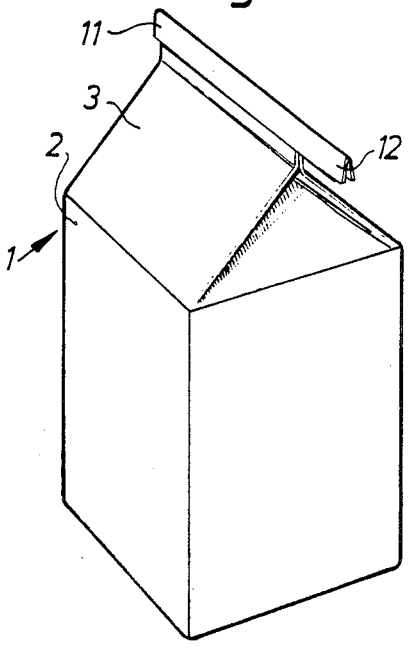
FIG. 3 is a perspective view of the packing container a closed condition and with the tearing strip applied.
Figure 4:
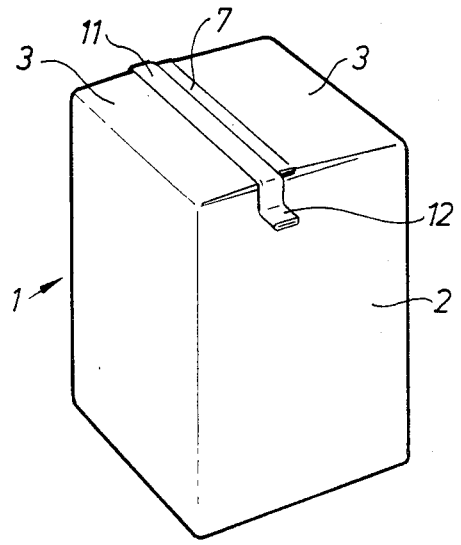
FIG. 4 is a perspective view of the packing container in accordance with FIG. 3 after folding down of the sealed portion.
Figure 5:
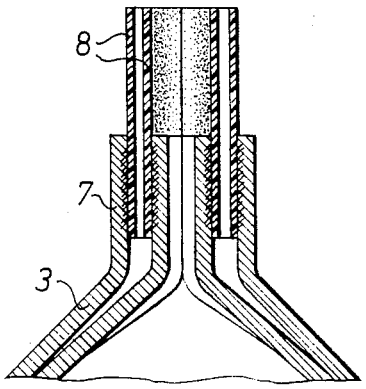
FIG. 5 is a sectional view through the sealing fin on the packing container in accordance with FIG. 2.
Figure 6:
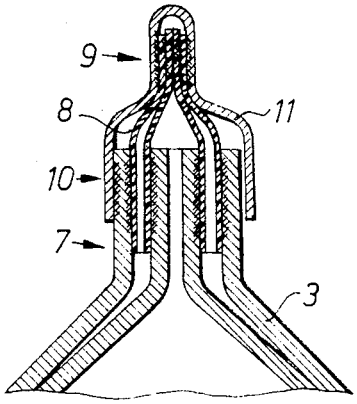
FIG. 6 is a sectional view through the sealing fin on the packing container in accordance with FIG. 3.

The packing container 1 illustrated comprises four side wall panels 2 of substantially equal size and a bottom (not shown) of conventional design. The top part of the packing container is divided by means of crease lines into a number of panels, which make possible a folding together and sealing of the top part. More particularly, the top part comprises two substantially rectangular roof panels 3, which are situated opposite each other and are connected to adjoining opposed side wall panels 2. As a continuation of the other pair of opposed side wall panels 2 the top part comprises triangular gable panels 4. Between the gable panels 4 and the roof panels 3 there are four triangular back-folding panels 5. Above the roof panels 3 and the back-folding panels 5 there are elongated sealing panels 6 which, after closing of the top part of the packing container, jointly form a sealing fin 7 (FIG. 2).

The packing container described above is of substantially conventional gable-top type. In general, such packing containers are closed in that the roof panels 3 are folded down in the direction towards one another at the same time as the gable panels 4, with the co-operation of the back-folding panels 5, are folded in under the roof panels 3 until the sealing panels 6 lie parallel with each other and jointly form the sealing fin 7. Then the sealing panels 6 are sealed together through the application of heat, which causes the outer thermoplatic layer of the material to melt, and the sealing panels can be pressed together and cooled to a durable seal. Directly above the top corner of the gable panels 4 the sealing panels 6 form two oppositely directed points, which very nearly meet each other when the sealing fin is folded up. Whilst the sealing fin in folded up condition assumes fourfold thickness owing to the folding in of the parts of the sealing panels 6 in between, it will in its central part just between the points of the folded-in sealing panels, only have twofold thickness. This causes difficulties in the sealing, since inevitably a vertical channel is formed in the sealing fin between the oppositely directed points of the sealing panels 6 situated in between. In order to avoid this leakage risk it has been tried to increase the pressure and the heat in the sealing process with the intention of pressing together the fibrous layers of the material and filling out the channel with thermoplastic material. Although this represents a clear improvement of tightness it means at the same time that the packing container will be very difficult to open, since the opening of the packing container presupposes that the seal between the sealing panels 6 can be broken again so as to make it possible for the one gable panel 4 with associated back-folding panel 5 to be folded out and to form a pouring spout. An increased sealing temperature and an increased sealing pressure also failed to bring about improvements of a kind such that the demands on gas-tightness and bacteria-tightness, inasfar as the package of sterile contents in aseptic packages is concerned, would be fulfilled.

Figure 1:
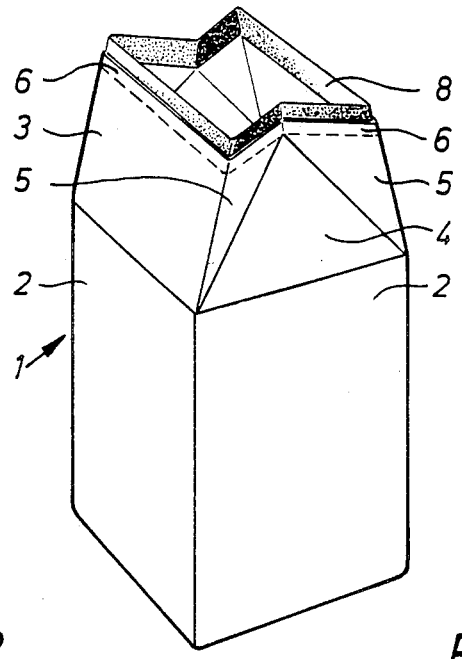
FIG. 1 is a perspective view of a packing container with an arrangement in accordance with the invention in an open position.

Through modification of the known packing containers with the help of the arrangement in accordance with the invention, an aseptically acceptable packing container is produced which at the same time is simple to open for the consumer. As is evident from FIG. 1 the packing container 1 of gable-top type is provided with a sealing film 8 which extends around the upper end of the packing container inside the sealing panels 6 and a little above their top edge, where the sealing film 8, after sealing of the top of the packing container, forms a sealing zone 9 wherein several layers of the sealing film 8 are sealed to one another. The sealing film 8 preferably consists of a 10-20 mm wide strip of a laminated material which comprises a layer of aluminium foil which is surrounded on both sides by layers of suitable plastic material which is capable of being sealed to the plastic layer situated on the inside of the packing material. The aluminium foil layer is preferably 7 $\mu$m thick whereas the two thermoplastic layers which, for example, may consist of polyethylene, have a thickness of 25 $\mu$m.

The sealing film 8 thus extends along the top edge of the packing container, the top edge of the sealing panels 6 dividing the sealing film 8 into an upper free part on which the sealing zone 9 is created and a lower part which in a second sealing zone 10 is sealed to the inside of the sealing panels 6 around the whole opening of the packing container. The sealing film 8 is appropriately joined to the packing material whilst the same is in plane form, that is to say in form of a web or in sheets. In the course of this the strip can be simply heat-sealed to the packing material in the sealing zone 10. In accordance with an alternative embodiment, the sealing film 8 may be constituted of a free part of a film laminated to the side of the packing material facing towards the inside of the packing container, that is to say constitute a continuation of the inner layer of the packing laminate, which in packing material for sterile packing containers generally consists of an aluminium foil layer and a polyethylene layer. This embodiment requires a different technique in the manufacture of the packing laminate, but in return saves in the phase concerned with the manufacture and application of a sealing film 8 in the form of a loose strip. Both methods are thus possible and both methods produce equivalent results.

When the sealing film 8 has been applied to the top edge of the packing material through sealing with the help of heat and pressure in the sealing zone 10 so that a liquid-tight seal is formed between the sealing film 8 and the sealing panels 6, the material is converted in a known manner to a packing container open at the top. After the packing container has been filled to the required level with contents the top is folded together by dropping down the roof panels against each other with simultaneous folding in of the gable panels 4, the back-folding panels 5 and the sealing panels 6 connected to them, so that the top part of the packing container obtains the shape as shown in FIG. 2. In the course of this operation the parts of the sealing film 8 which are joined to the parts of the sealing panels 6 situated above the back-folding panels 5 will be placed between the parts of the sealing film 8 which are situated above the roof panels 3. This sealing pattern corresponds to the sealing pattern which generally occurs upon closing of gable-top packages, but owing to the arrangement in accordance with the invention, the occurrence in the sealing zone of packing laminate containing fibrous material (and thus being relatively thick, approx. 0.5 mm) is avoided, which makes it possible, with the help of heat and pressure, to provide a sealing zone 9 in the upper, free part of the sealing film 8 which satisfies the high demands made on tightness. The relatively thin aluminium foil layer in the sealing film 8, as well as the partly melted thermoplastic layers simply can be pressed together so that channel formation owing to the sealing is prevented at the transition between unequal numbers of layers in the central part of the fin. After the sealing of the sealing film 8, a tearing strip 11 is applied alongside the sealed-up fin, this strip being joined to the upper part of the sealing film 8 on which is situated the sealing zone 9. The tearing strip preferably is doubled and is sealed to both free surfaces of the sealing film 8. The tearing strip, moreover, has a gripping part 12 projecting from the sealing fin 7 which, when the packing container is to be opened, is made use of for tearing off the tearing strip 11 from the package top, accompanied by the upper part of the sealing film 8. The film will break between the sealing zone 9 and the sealing zone 10, especially in the region situated directly above the top edge of the sealing panels 6, since the said edge serves as a hold-up in the tearing off process. If the tearing is discontinued when the tearing strip has been removed to half its length, the one gable panel 4 of the packing container can be folded out so that a pouring spout can be formed in conventional manner. It is also possible to remove the tearing strip 11 completely together with the underlying part of the sealing film 8, thus making it possible for the whole top of the packing container to be opened, so that the contents become accessible by means of a spoon.

The arrangement in accordance with the invention also can be used for gable-top packages of the type having a substantially flat top, which in a known manner is achieved through an adaptation of the geometry of the different top panels and a folding down of the sealing fin after the closing. Here the projecting gripping part of the tearing strip 11 and possibly a similarly projecting part at the opposite end of the tearing strip serve as fastening elements for retaining the sealing fin in folded down position. The projecting parts of the tearing strip 11, here may be heat-sealed to the two opposite side wall panels 2 of the packing container after the sealing and folding down of the sealing fin, whilst it is preferred to leave the outer part of one end of the tearing strip 11 unsealed, so as to form a gripping part 12 which facilitates the opening of the packing container. In order to avoid unnecessary stresses on the part of the sealing film provided with sealing zones 9, it is appropriate in this embodiment to seal the tearing strip to the outside of the sealing fin 7, in any case on the side of the fin facing upwards.

It may be desirable for various reasons to cover the projecting part of the sealing film with packing material. This is possible if the two parts of the sealing panels 6 situated before the roof panels 3 are given a greater height than the parts of the sealing panels situated in between, that is to say the parts situated above the back-folding panels 5. Appropriately the greater height of the panel sections corresponds to the height of the free part of the sealing film. The tearing strip here ought to be placed between the packing material and the sealing film, the corresponding upper parts of the panels 6 of the sealing fin being delimited from parts located below by means of a tearing indication and being attached to the tearing strip so that they accompany the same when the packing container is opened.

Especially on packing containers of the so-called flat-top type it may also be appropriate to dispense with the tearing strip 11 and instead extend one of the said sealing panels 6, namely the one which after folding down of the top will lie over, and cover, the projecting part of the sealing film 8 provided with the sealing zone 9. The sealing film 8 here is sealed to the extended panel which in order to facilitate the opening of the packing container is also provided with a tearing indication, which appropriately runs at the same level as the top edge of the packing container and thus delimits the said extended panel part from the adjoining sealing panel 6. The higher sealing panel 6 extended over the top edge of the packing container may possibly also serve as a fastening element for the folded down sealing fin.

I claim:

1. A closure arrangement on a packing container of the type constructed of a folded and sealed flexible packing material having an inside surface, the packing container having an upper part including panels which jointly form a sealing fin of multiple material thickness, the sealing fin including a top edge, the closure arrangement comprising; a sealing film joined to the inside surface of the packing material, the sealing film including a sealing zone located outside the top edge of the sealing fin, the sealing zone being covered by, and joined to, a separate tearing strip, wherein several layers of the sealing film are sealed to one another.

2. An arrangement in accordance with claim 1, wherein the tearing strip has a projecting gripping part which is joined in a detachable manner to the packing container and is adapted to retain the fin in folded down position against the packing container.

3. An arrangement in accordance with claim 1, wherein the tearing strip is double and is sealed to the sealing film along opposite sides of the top edge.

4. An arrangement in accordance with claim 3, wherein the tearing strip is doubled and covers the sealing zone.

5. An arrangement in accordance with claim 1, wherein the tearing strip is joined to the sealing fin.

* * * * *